US005761841A

United States Patent [19]

Snick

[11] Patent Number: 5,761,841

[45] Date of Patent: Jun. 9, 1998

[54] FIREARM MAGAZINE FOR USE WITH A RIFLE

[76] Inventor: John W. Snick, 1740 Thorneapple La., Algonquin, Ill. 60102

[21] Appl. No.: 790,769

[22] Filed: Jan. 27, 1997

[51] Int. Cl.[6] ..... F41A 9/61

[52] U.S. Cl. ..... 42/50

[58] Field of Search ..... 42/50, 18, 7, 6

[56] References Cited

U.S. PATENT DOCUMENTS

| | | | |
|---|---|---|---|
| 3,465,463 | 9/1969 | Grandy et al. | 42/50 |
| 3,516,189 | 6/1970 | Lewis et al. | 42/50 |
| 3,574,264 | 4/1971 | Simmons, Sr. | 42/6 |
| 3,732,643 | 5/1973 | Wells | 42/50 |
| 4,614,052 | 9/1986 | Brown et al. | 42/87 |
| 4,777,752 | 10/1988 | Howard | 42/50 |
| 5,319,871 | 6/1994 | Racheli | 42/50 |
| 5,329,718 | 7/1994 | Howard | 42/50 |
| 5,375,359 | 12/1994 | Chesnut et al. | 42/50 |
| 5,566,487 | 10/1996 | Vaid et al. | 42/7 |
| 5,588,241 | 12/1996 | Hurley | 42/50 |

*Primary Examiner*—Charles T. Jordan
*Assistant Examiner*—Meena Chelliah
*Attorney, Agent, or Firm*—Meroni & Meroni

[57] ABSTRACT

A firearm magazine is disclosed for use with a rifle. The magazine includes a housing defining an interior chamber therewithin. The interior chamber is adapted for holding a plurality of cartridges oriented in stacked abutting fashion with respect to one another. The housing has a rear side having an outwardly extending vertically oriented protrusion. The protrusion forms a channel on an interior side of the rear side in communication with the interior chamber. The channel is sized for receiving a rear portion of each of the plurality of cartridges therewithin.

16 Claims, 5 Drawing Sheets

FIREARM MAGAZINE FOR USE WITH A RIFLE

BACKGROUND OF THE INVENTION

1. Field of the Invention

The present invention relates generally to a firearm magazine. More particularly, the invention pertains to a firearm magazine which can accept a cartridge which is longer than those used in conventional magazines for use with rifles.

2. Description of the Prior Art

The effective range of any firearm depends largely on the type of bullet that can be used. Longer bullets have the potential for higher ballistic coefficients which make them less susceptible to wind and atmospheric resistance thus increasing the effective range and accuracy of the cartridge. Longer bullets usually mean that the overall cartridge length will also increase sometimes to the point that they no longer fit into a standard magazine.

The current magazine for an AR-15 type rifle, for example, limits the overall length of the cartridge so that the rifle cannot take advantage of the longer cartridges. To use the longer cartridge, the cartridge must be loaded singly, one at a time, into the chamber thus bypassing the magazines intended use altogether. This also effectively turns a semi-automatic rifle, in this instance, into a single shot rifle. For High Power/target rifle competition, varmint hunting, or even recreational target practice this can be unacceptable. The present option is to use shorter cartridges that fit into the magazine at the expense of the accuracy improvement that can be obtained with the longer cartridges/bullets especially as target distances increase.

In High Power matches, which are a form of target competition, the problem of the longer cartridges not being able to fit in the current magazine is significant. This problem is especially evident in the AR-15 which is a common rifle used in the Service Rifle Class of High Power target competition. High Power competition consists of four basic stages which make up the match. Two of these stages are rapid fire stages where the competitor usually loads and fires two rounds, then reloads and fires eight more for a total of ten rounds or cartridges in a limited time frame. The sitting rapid fire stage has a sixty second limit and is fired at a distance of 200 yards. The prone rapid fire stage has a seventy second limit and is fired at a distance of 300 yards. Clearly sixty or seventy seconds is not enough time to repeat the process for ten rounds of singly loading a rifle, aiming, firing, picking up a new cartridge, and manually inserting it into the chamber. However, this process is what would be required if the longer cartridges that don't fit in the magazine were used. Therefore the competitors use the shorter cartridges which fit in the magazine for the rapid fire stages at the expense of the accuracy. The competitors use the more accurate longer cartridges for the slow fire events where there is ample time to singly load each cartridge.

Since two different length cartridges are used, the rifle chamber that the bullet resides in must be compromised to work for both length cartridges. It has been shown that chamber characteristics/dimensions have significant effects on accuracy. Usually the chamber is optimized for best accuracy with the longest cartridge to be used at the expense of the shorter cartridges thereby having the shorter cartridge being even less accurate that they potentially could be. If only one length of cartridge were used, the barrel chamber could be optimized for that length alone, thus having the most accuracy potential.

Therefore the need exists for a magazine which is long enough to accommodate the longer cartridges which have more accuracy potential, especially at longer distances, than the shorter cartridges that fit in the standard magazine. This magazine must retain substantially the same outside dimensions so that it will still fit in the same intended firearm. Further, this will allow the barrel to be optimized for one cartridge length now that the longer cartridges can now be used in High Power rapid fire events as well as the slow fire events, which was not previously possible.

As will be described in greater detail hereinafter, the apparatus of the present invention differs from those previously proposed and employs a number of novel features that render it highly advantageous over the prior art.

SUMMARY OF THE INVENTION

Accordingly, it is an object of this invention to provide a magazine which is configured to accommodate cartridges longer than the cartridges that fit in the standard magazine.

Another object of this invention is to provide a magazine that is sized to fit within a conventional type of rifle.

To achieve the foregoing and other objectives, and in accordance with the purposes of the present invention a firearm magazine is provided for use with a rifle. The magazine includes a housing defining an interior chamber therewithin. The interior chamber is adapted for holding a plurality of cartridges oriented in stacked abutting fashion with respect to one another. The housing has a rear side having an outwardly extending vertically oriented protrusion. The protrusion forms a channel on an interior side of the rear side in communication with the interior chamber. The channel is sized for receiving a rear portion of each of the plurality of cartridges therewithin.

Other objects, features and advantages of the invention will become more readily apparent upon reference to the following description when taken in conjunction with the accompanying drawings, which illustrate several embodiments of the invention.

DETAILED DESCRIPTION OF THE PREFERRED EMBODIMENT

Figure 1:
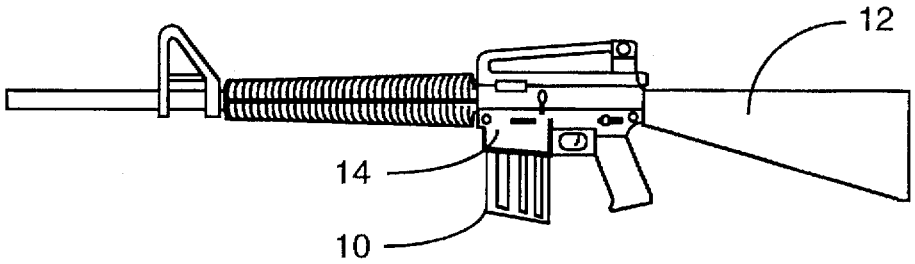
FIG. 1 is a perspective view of a rifle for use with the present invention.
Figure 2:
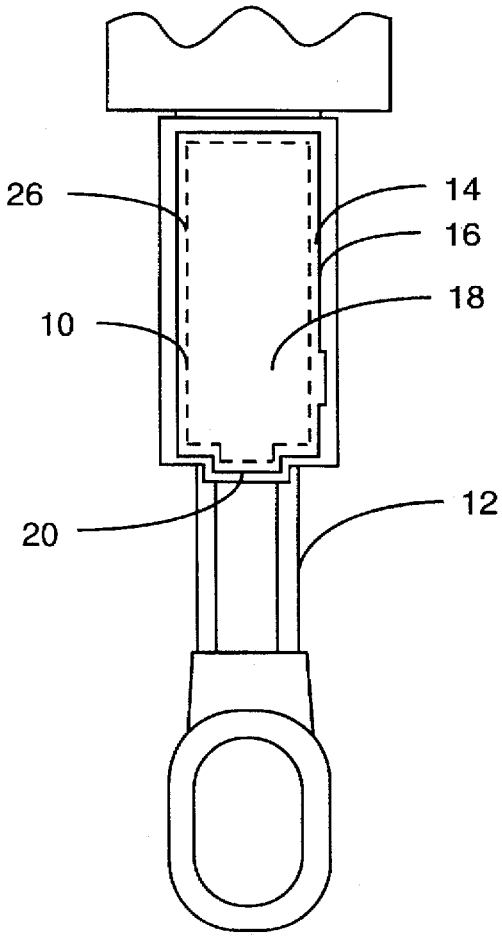
FIG. 2 is a partial bottom view of the rifle.

Referring now to the drawings, a firearm magazine 10 for use with a rifle 12 of the type having a magazine-receiving chamber 14, is illustrated in FIGS. 1 and 2. The magazine-receiving chamber 14 has sidewalls 16 forming a generally rectangular opening 18. One of the sidewalls 16 has an outwardly extending portion 20.

The purpose of portion 20 on known rifles is work in combination with prior art magazines 200, as shown in FIG.

8, which key the magazine 200 with a protrusion 202 so it only fits into the rifle 12 one way and to further house part of a follower 204. This prior art follower 204 is under upward tension such that when the last cartridge has been expended, the follower 204 applies pressure to a bolt catch arm 206. The bolt catch arm 206 in turn pushes up the bolt catch of the rifle (not shown) which blocks the forward progress of the bolt, locking the bolt in an open position after the last cartridge has been fired.

It is significant to note that the magazine 10 of the present invention is designed to work with existing rifles 12 that have such above-described magazine-receiving chambers 14. Such types of rifles are believed to include but not limited to the following: SKS (Samozaridyna Karabina Simonova), Bushmaster M17S Bullpup, AR-10, AR-15, M-16, Colt M4, and Daewoo DR200. However, modifications to these rifles with respect to the bolt catch as later described is typically necessary.

Figure 3:
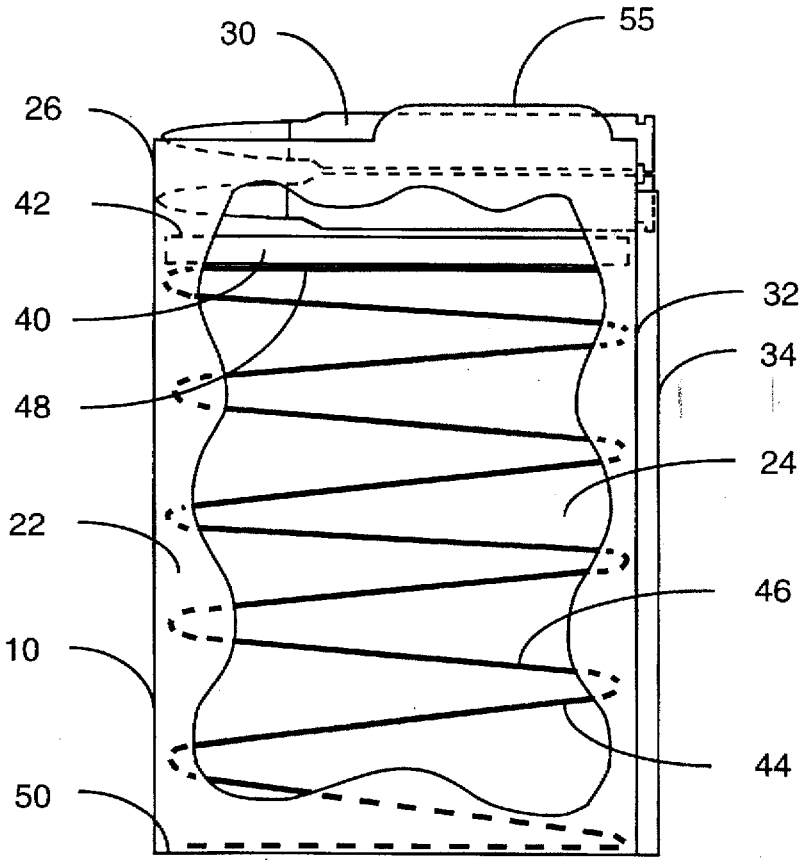
FIG. 3 is a side view of the magazine of the present invention.
Figure 4:
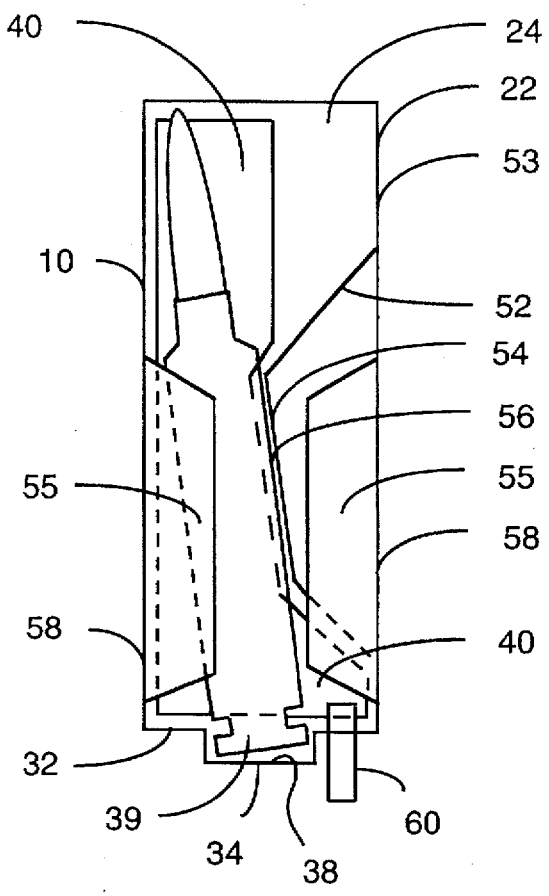
FIG. 4 is a top view of the present invention.
Figure 5:
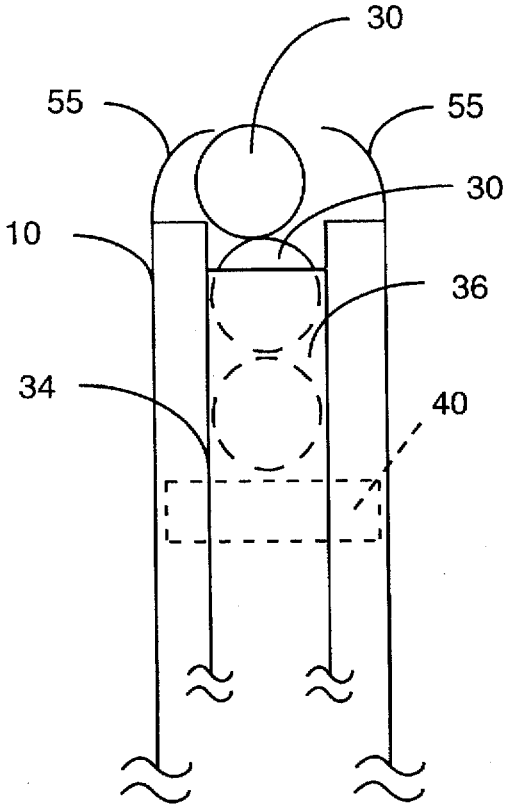
FIG. 5 is a diagrammatic end view of the present invention.

Referring to FIGS. 3–5, the firearm magazine 10 includes a housing 22 defining an interior chamber 24 therewithin. A top portion 26 of the housing 22 is sized and configured for engaging the magazine-receiving chamber 14 (FIG. 2). The interior chamber 24 is adapted for holding a plurality of first or second cartridges 28, 30 oriented in stacked parallel abutting fashion with respect to one another. The housing 22 has a rear side 32 having an outwardly extending vertically oriented protrusion 34. The protrusion 34 forms a channel 36 (FIG. 4) on an interior side 38 of the rear side 32 in open communication with the interior chamber 24. The channel 36 is sized for receiving a rear portion 39 of each of the cartridges 28, 30 therewithin and accordingly has a width greater than the diameter of the cartridges 28, 30. In one preferred embodiment for use with cartridges 28, 30 having a diameter of about 0.373 inches, the channel has a width of approximately 0.415 inches. However, it should be understood that rifles using cartridges of greater diameter will correspondingly require a larger channel.

As best illustrated in FIG. 3, a follower plate 40 is movable within the housing 22. An upper surface 42 of the follower plate 40 is adapted for supporting a cartridge 28, 30 thereupon. A biasing assembly 44 including a spring 46 disposed with the interior chamber 24 between a lower surface 48 of the follower plate 40 and a bottom 50 of the housing 22. The assembly 44 engages the follower plate 40 for resiliently moving the follower plate 40 vertically within the interior chamber 24 to advance a cartridge 28,30 into the rifle 12 as needed.

Referring to FIG. 4, a vertically oriented cartridge-guiding plate 52 is mounted to the housing 22 within the interior chamber 24 along a side 53 of the housing 22. The cartridge-guiding plate 52 has an outer surface 54 adapted for extending immediately adjacent to sides 56 of the cartridges 28,30 to support and hold the cartridges 28,30 in a predetermined position relative to the housing 22. In a preferred embodiment, the outer surface 54 of the cartridge-guiding plate 52 is in angled relationship to outer sides 58 of the housing 22 which are perpendicular the rear side 32 so that a longitudinal axis of each of the cartridges 28,30 is in angled relationship to the outer sides 58. Upwardly extending curved portions 55 hold the cartridges 30 in place until removed manually or by the rifle.

Figure 6:
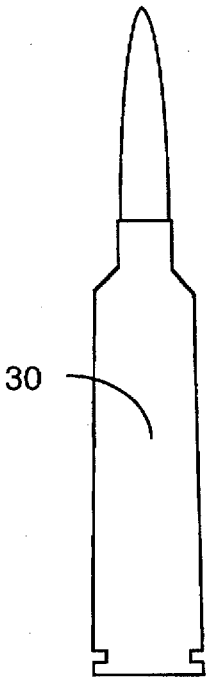
FIG. 6 is a side view of a longer type of cartridge for use with the present invention.
Figure 7:
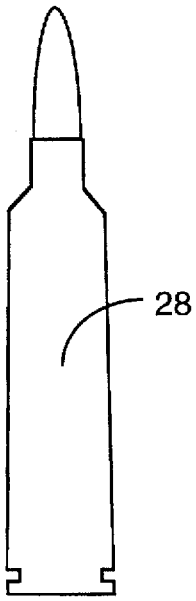
FIG. 7 is a side view of a shorter type of cartridge for use with the present invention.
Figure 8:
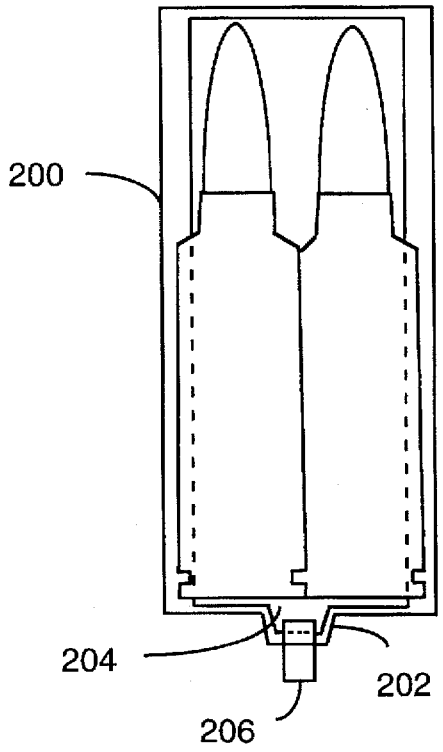
FIG. 8 is a top view of a prior art magazine.

By using protrusion 34 of magazine 10 to house a portion of a cartridge, the length of the cartridge can be significantly increased when compared to the cartridge used in a current magazine. For example, with an AR-15 type rifle, a cartridge 28 having a length of approximately 2.25 inches is the greatest length usable with a prior art magazine 200 (FIG. 8). However, by using the magazine 10 of the present invention, a cartridge 30 may also be employed having a length of approximately 2.50 inches which is longer than cartridge 28 (FIGS. 6 and 7).

A bolt catch arm 60 of the present invention can no longer reside in protrusion 34 as a result of cartridge 28,30 now occupying that area. Therefore, the bolt catch arm 60 must be adapted and moved either to the left or right of cartridge 28,30 as shown in FIG. 4. The length of bolt catch arm 60 must also be lengthened to contact the follower plate 40 since the cartridge 30 will now reside in protrusion 34 unlike the prior art magazine 200 shown in FIG. 8.

Accordingly, the present invention will allow for greater cartridge length in a magazine by using the protrusion area to house the rear or head of the cartridge while still keeping the similar outside dimensions of the current magazine which insures the magazine will still fit in same firearm without significant modification.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A firearm magazine for use with rifles of the type having a magazine-receiving chamber, the magazine-receiving chamber having sidewalls forming a generally rectangular opening, one of said sidewalls having an outwardly extending portion, the firearm magazine comprising: a housing defining an interior chamber therewithin, a top portion of the housing being sized and configured for engaging said magazine-receiving chamber, the interior chamber being adapted for holding a plurality of cartridges vertically oriented in stacked abutting fashion with respect to one another, the housing having a rear side having an outwardly extending vertically oriented protrusion, the protrusion forming a channel on an interior side of the rear side in communication with the interior chamber, the channel having a width greater than a width of a rear portion of each of said plurality of cartridges and being sized for receiving the rear portion of each of said plurality of cartridges therewithin to allow outermost edges of each of said plurality of cartridges to be positioned rearwardly of a vertical plane extending through the rear side of the housing to enable each of said plurality of cartridges to have an increased length.

2. The firearm magazine of claim 1, further comprising a follower plate movable within said housing, an upper surface of said follower plate adapted for supporting at least one of said cartridges thereupon, and biasing means disposed with the interior chamber between a lower surface of said follower plate and a bottom of said housing and engaging said follower plate for moving said follower plate vertically within the interior chamber.

3. The firearm magazine of claim 1, wherein the channel has a width of at least 0.373 inches.

4. The firearm magazine of claim 1, further comprising a vertically oriented cartridge-guiding plate mounted to the housing within the interior chamber, the cartridge-guiding plate having an outer surface adapted for extending immediately adjacent to sides of the plurality of cartridges to support and hold the plurality of cartridges in a predetermined position relative to the housing.

5. The firearm magazine of claim 4, wherein the outer surface of the cartridge-guiding plate is in angled relationship to outer sides of the housing which are perpendicular to the rear side so that a longitudinal axis of each of the plurality of cartridges is in angled relationship to said outer sides.

6. A firearm magazine comprising: a housing defining an interior chamber therewithin, the interior chamber being adapted for holding a plurality of cartridges vertically oriented in stacked abutting fashion with respect to one another, the housing having a rear side having an outwardly extending vertically oriented protrusion, the protrusion forming a channel on an interior side of the rear side in communication with the interior chamber, the channel having a width greater than a width of a rear portion of each of said plurality of cartridges and being sized for receiving the rear portion of each of said plurality of cartridges therewithin to allow outermost edges of each of said plurality of cartridges to be positioned rearwardly of a vertical plane extending through the rear side of the housing to enable each of said plurality of cartridges to have an increased length.

7. The firearm magazine of claim 6, further comprising a follower plate movable within said housing, an upper surface of said follower plate adapted for supporting at least one of said cartridges thereupon, and biasing means disposed with the interior chamber between a lower surface of said follower plate and a bottom of said housing and engaging said follower plate for moving said follower plate vertically within the interior chamber.

8. The firearm magazine of claim 6, wherein the channel has a width greater than the diameter of one of said cartridges.

9. The firearm magazine of claim 8, wherein the channel has a width of at least 0.373 inches.

10. The firearm magazine of claim 8, further comprising a vertically oriented cartridge-guiding plate mounted to the housing within the interior chamber, the cartridge-guiding plate having an outer surface adapted for extending immediately adjacent to sides of the plurality of cartridges to support and hold the plurality of cartridges in a predetermined position relative to the housing.

11. The firearm magazine of claim 10, wherein the outer surface of the cartridge-guiding plate is in angled relationship to outer sides of the housing which are perpendicular the rear side so that a longitudinal axis of each of the plurality of cartridges is in angled relationship to said outer sides.

12. A rifle and firearm magazine comprising in combination: a rifle of the type having a magazine-receiving chamber, the magazine-receiving chamber having sidewalls forming a generally rectangular opening, one of said sidewalls having an outwardly extending portion, a firearm magazine having a housing defining an interior chamber therewithin, a top portion of the housing being sized and configured for engaging said magazine-receiving chamber, the interior chamber being adapted for holding a plurality of cartridges vertically oriented in stacked abutting fashion with respect to one another, the housing having a rear side having an outwardly extending vertically oriented protrusion, the protrusion forming a channel on an interior side of the rear side in open communication with the interior chamber, the channel having a width greater than a width of a rear portion of each of said plurality of cartridges and being sized for receiving the rear portion of each of said plurality of cartridges therewithin to allow outermost edges of each of said plurality of cartridges to be positioned rearwardly of a vertical plane extending through the rear side of the housing to enable each of said plurality of cartridges to have an increased length, a follower plate movable within said housing, an upper surface of said follower plate adapted for supporting at least one of said cartridges thereupon, and biasing means disposed with the interior chamber between a lower surface of said follower plate and a bottom of said housing and engaging said follower plate for moving said follower plate vertically within the interior chamber.

13. The combination of claim 12, wherein the channel has a width greater than the diameter of one of said cartridges.

14. The combination of claim 13, further comprising a vertically oriented cartridge-guiding plate mounted to the housing within the interior chamber, the cartridge-guiding plate having an outer surface adapted for extending immediately adjacent to sides of the plurality of cartridges to support and hold the plurality of cartridges in a predetermined position relative to the housing.

15. The combination of claim 14, wherein the outer surface of the cartridge-guiding plate is in angled relationship to outer sides of the housing which are perpendicular the rear side so that a longitudinal axis of each of the plurality of cartridges is in angles relationship to said outer sides.

16. The combination of claim 13, wherein the rifle is an AR-15 type rifle.

* * * * *